United States Patent [19]

Nelson

[11] 4,343,502

[45] Aug. 10, 1982

[54] DOORKNOB CONSTRUCTION

[75] Inventor: Kenneth R. Nelson, West Vancouver, Canada

[73] Assignee: Ingersoll-Rand Company, Woodcliff Lake, N.J.

[21] Appl. No.: 195,390

[22] Filed: Oct. 9, 1980

[51] Int. Cl.[3] ..... E05B 15/02

[52] U.S. Cl. ..... 292/356; 16/121; 74/548

[58] Field of Search ..... 292/357, 356, 350; 16/121; 74/548, 553

[56] References Cited

U.S. PATENT DOCUMENTS

| | | | |
|---|---|---|---|
| 629,123 | 7/1899 | Davis | 292/356 |
| 2,141,659 | 12/1938 | Nehls | 292/356 UX |

FOREIGN PATENT DOCUMENTS

| | | | |
|---|---|---|---|
| 40876 | 9/1937 | Netherlands | 292/350 |
| 398012 | 7/1933 | United Kingdom | 292/356 |

*Primary Examiner*—Andrew V. Kundrat

*Attorney, Agent, or Firm*—Walter C. Vliet

[57] ABSTRACT

A method of retaining Mortise Lock knobs and levers wherein a threaded male journal is provided on the knob or lever which co-acts with a female threaded nut whose outer diameter becomes a journal bearing surface permitting rotation of the knob or lever. A shoulder is provided at one end of the female threaded nut which becomes the retainer for the lock rose bushing. The shoulder end of the female threaded nut is perforated at its center line with an internal star-shaped hole which in turn accepts a standard square spindle which also co-acts with a square hole provided in the knob or lever.

The center of the star hole being concentric to the centerline of the bushing, the centerline of the square spindle and the centerline of rotation of the knob or lever. The female threaded nut provides continuous clearance adjustment while the interaction between the star-shaped hole, the square spindle and the square hole in the knob or lever provides secure rotation of the knob or handle within the rose bushing.

7 Claims, 1 Drawing Figure

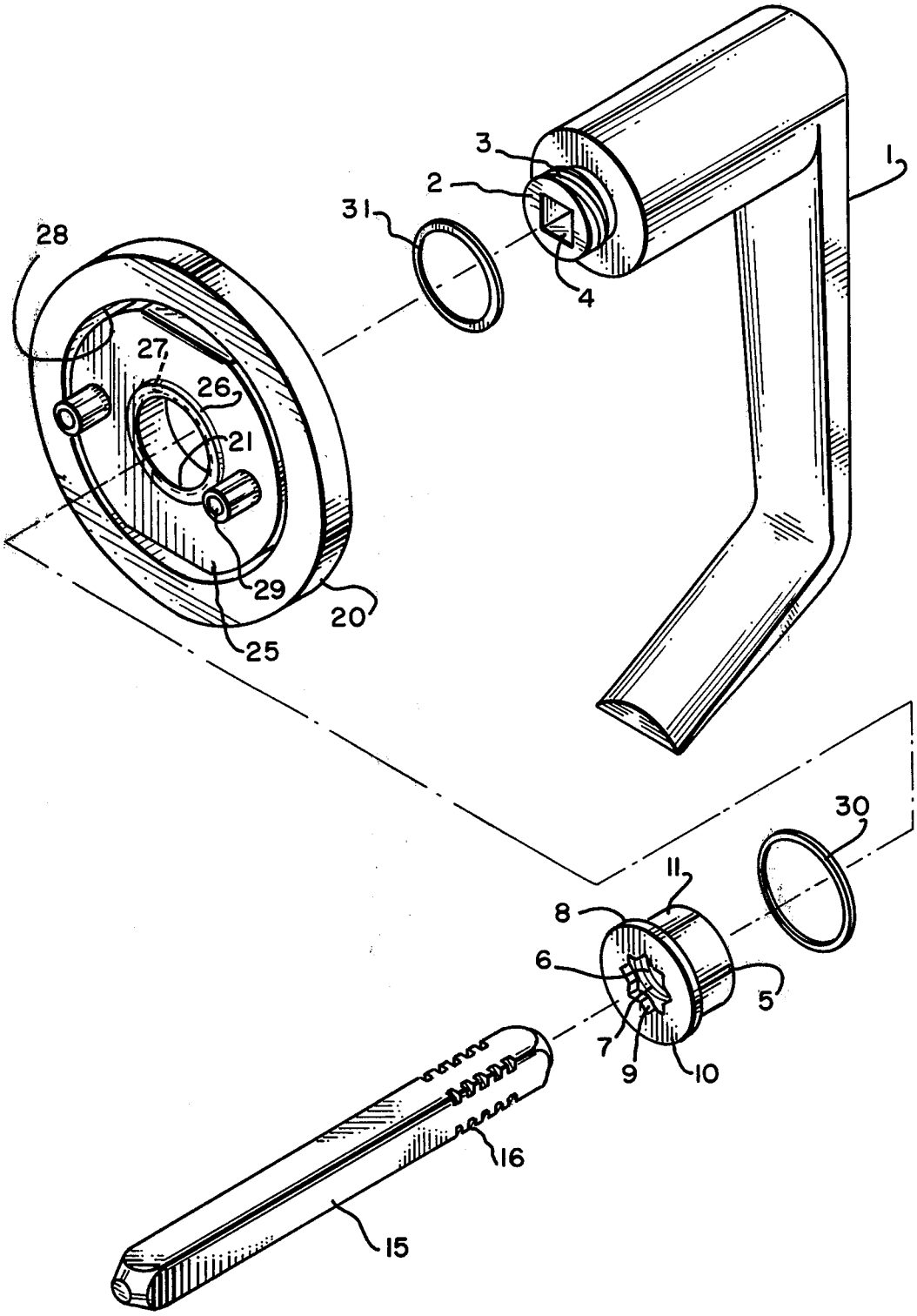
1
2
3
4
5
6
7
8
9
10
11
15
16
20
21
25
26
27
28
29
30
31

DOORKNOB CONSTRUCTION

BACKGROUND OF THE INVENTION

Mortise locks have experienced problems with the attachment of operating trim including knobs and levers to the locks. In a mortise lock installation, the mortise chassis is slid into an edge pocket in the door and it is secured and operated by a transverse square spindle inserted into the chassis. Operating members slide onto the spindle and are retained there by two flanges commonly called roses which are bolted together through the door. These roses carrying the knobs or levers. The knobs or levers must rotate freely independent of the rose, but they must be prevented from escaping axially from the rose.

In the past, the knobs or levers have been retained by snap rings, truarc rings, pins or set screws, none of which have proven to be entirely reliable, or adjustable for tolerance or wear.

SUMMARY OF THE INVENTION

The object of this invention is to provide a secure means for attaching knobs and levers to mortise locks.

A further object of the invention is to provide a simple and reliable means for attaching the knob or lever to the mortise lock rose which further provides for axial adjustment of the clearance between the retaining flange and the operating lever.

Yet a further object is to provide a doorknob construction which is inexpensive to manufacture, easy to assembly and yet provides a more secure installation than presently obtained. These and other objects are obtained in a doorknob construction comprising: a rotating hand operator threaded about its centerline of rotation at one end, a non-circular bore in the operator along the centerline of rotation; an adjustment bushing in threaded engagement with the thread on the hand operator, the adjustment bushing having a shoulder provided at one end opposite the hand operator and a journal bearing surface concentric about the centerline of rotation intermediate the shoulder and the opposite end of the adjustment bushing, a hand operator mounting means disposed about the journal bearing surface, the adjustment bushing being further provided with an indexing non-circular hole at the one end disposed concentrically about the centerline of rotation, and a spindle of non-circular cross section inserted into the non-circular bore of said hand operator and said indexing non-circular hole in the adjusting bushing and cooperating with each to rotate the spindle and prevent rotation of the adjustment bushing relative to the hand operator once the spindle is inserted.

BRIEF DESCRIPTION OF THE DRAWING

FIG. 1 is an iosmetric exploded assembly view of the doorknob construction according to this invention.

DESCRIPTION OF THE PREFERRED EMBODIMENT

FIG. 1 shows an exploded assembly view of a doorknob assembly wherein the hand operator or lever or handle has a threaded male journal 2 provided at one end. For purposes of the embodiment herein described, the male journal is provided with an external thread 3. The handle is further provided with a square recess 4 which extends into the handle or lever for approximately 3 to 6 or more times the width of the square recess.

An adjustment bushing 5 is provided with a hollow bore 6 at one end. The hollow bore 6 is in turn provided with an internal thread 7 which on assembly cooperates with external thread 3 on the handle. The other end of the adjustment bushing is further provided with a star-shaped hole 9 in the face of its other end. The star-shaped hole is concentric about the centerline of the bushing and extends through the face of the bushing 10 into the hollow bore 6.

A mortise lock rose 20 on assembly is interspaced between the handle and the shoulder 8 of the adjustment bushing. The cylindrical outer surface 11 of the bushing forms a journal about which the rose 20 may rotate. The rose in turn is provided with a journal bearing 21 which may be formed as an integral part of the rose or which may be press-fit into a bore in the rose plate. A mounting plate 25 is shown disposed about the journal bearing 21 and an internal bore 27 of the mounting plate cooperates with the journal bearing to allow rotation of the mounting plate relative to the rose.

A rolled edge 26 of the journal bearing 21 serves to retain the mounting plate 25 in the rose. The mounting plate is shown assembled in a hollow bore or recess 28. The mounting plate 25 is essentially a washer-shaped plate having its internal bore 27 cooperating with the journal bearing 21. One face of the mounting plate bears on the face of the internal recess 28 of the rose 20.

The internal recess 28 extends for approximately ½ the thickness of the rose. The thickness of the mounting plate 25 is less than the depth of the recess such that when the rolled edge 26 is completed, the mounting plate will not extend beyond the face of the rose. The mounting plate is provided with two mounting screw bosses 29 which are used to assemble the rose to the mortise lock, as is common practice in the industry.

Interspaced between the shoulder of the adjustment bushing and the face of the journal bearing 21 is a spacer 30 which may be made of a plastic material such as nylon. A second spacer 31 is interspaced between the face of the rose and the handle.

On assembly, the adjustment bushing is inserted through the inner bore of journal bearing 21 and the male journal of the handle is then threaded into the internal thread of the adjustment bushing. The adjustment bushing 5 is tightened until the desired clearance is obtained between the shoulder 8, the journal bearing 21 of the rose 20 and the handle including the spacers 30 and 31. The bushing is adjusted to zero clearance, then backed off until the first set of flats in the star hole align with the flats of the square recess.

The spindle 15 is then inserted through the star hole into the square hole of the handle. Serrations 16 provided on the spindle provide edge upset interference to cooperate with the square recess 4 to retain the spindle in the square recess. In addition, the square recess in the handle, the square spindle and the flats of the star hole cooperate to prevent the adjustment bushing 5 from further rotation after assembly. The shoulder 8 of the adjustment bushing nut securely holds the handle to the mounting rose.

It can be appreciated by one skilled in the art that a secure and novel doorknob construction has been described. It should be obvious to one skilled in the art that the male journal, alternatively, may be internally bored and threaded to accept an adjustment bushing which is externally threaded to accomplish the same invention. In addition, the rose and the mounting plate may be one piece construction. Numerous other variations are possible within the scope of the invention, and I do not wish to be limited in the scope of my invention except as claimed.

I claim:

1. A doorknob assembly comprising:

a rotating hand operator threaded about its centerline of rotation at one end;

a non-circular bore in said operator along said centerline of rotation;

an adjustment bushing in threaded engagement with the thread on said hand operator;

said adjustment bushing having a shoulder provided at one end opposite said hand operator and a journal bearing surface concentric about said centerline of rotation intermediate said shoulder and the opposite end of said adjustment bushing;

a hand operator mounting means disposed for rotation on and orientation about said journal bearing surface;

said adjustment bushing being further provided with an indexing non-circular hole at said one end disposed concentrically about said centerline of rotation; and a spindle of non-circular cross section inserted into said non-circular bore of said hand operator and said indexing non-circular hole in said adjusting bushing and cooperating with each to rotate said spindle and prevent rotation of said adjustment bushing relative to said hand operator once said spindle is inserted.

2. A doorknob assembly according to claim 1 wherein:

said non-circular bore in said operator is of square cross section;

said indexing non-circular hole in said adjustment bushing is a star configuration having an integer multiple of four points; and said spindle is of square cross section.

3. A doorknob assembly according to claim 1 wherein:

said rotating hand operator is a doorknob.

4. A doorknob assembly according to claim 1 wherein:

said rotating hand operator is a lever operator.

5. A doorknob assembly according to claim 1 wherein:

said hand operator is provided with an external thread about its centerline of rotation at one end; and said adjustment bushing is provided with an internal thread at its opposite end for threaded engagement with said hand operator.

6. A doorknob assembly according to claim 1 wherein:

said hand operator is provided with an internal thread about its centerline of rotation at one end; and said adjustment bushing is provided with an external thread at its opposite end for threaded engagement with said hand operator.

7. A doorknob assembly according to claim 1 wherein:

said shoulder provided at one end of said bushing secures said hand operator to said hand operator mounting means with adjustable clearance as provided by the indexing feature of said indexing non-circular hole in said adjustment bushing and said mounting means further comprises a decorative rose journalled for rotation about said journal bearing surface, said rose having a mounting plate further journalled for concentric rotation about said rose and said adjustment bushing.

* * * * *